US012129652B2

(12) United States Patent
Malinowski et al.

(10) Patent No.: US 12,129,652 B2
(45) Date of Patent: Oct. 29, 2024

(54) BUILDING SYSTEM AND METHOD UTILIZING INTEGRATED INSULATION, METHOD TO CONSTRUCT WALL PANEL

(71) Applicant: INTEGRATED STEEL BUILDING, LLC, Minden, NV (US)

(72) Inventors: Edward Malinowski, Newtown, PA (US); Wei Wang, New York, NY (US)

(73) Assignee: Integrated Steel Panels LLC, Casper, WY (US)

( * ) Notice: Subject to any disclaimer, the term of this patent is extended or adjusted under 35 U.S.C. 154(b) by 330 days.

(21) Appl. No.: 17/694,460

(22) Filed: Mar. 14, 2022

(65) Prior Publication Data

US 2022/0205242 A1 Jun. 30, 2022

Related U.S. Application Data

(60) Continuation-in-part of application No. 17/125,209, filed on Dec. 17, 2020, now abandoned, which is a division of application No. 16/891,785, filed on Jun. 3, 2020, now Pat. No. 10,934,711, which is a continuation-in-part of application No. 15/724,666, filed on Oct. 4, 2017, now abandoned.

(51) Int. Cl.

| | |
|---|---|
| ***E04C 2/38*** | (2006.01) |
| ***E04B 1/14*** | (2006.01) |
| ***E04C 2/32*** | (2006.01) |

(52) U.S. Cl.

CPC ..... *E04C 2/38* (2013.01); *E04B 1/14* (2013.01); *E04C 2/322* (2013.01)

(58) Field of Classification Search

None

See application file for complete search history.

(56) References Cited

U.S. PATENT DOCUMENTS

| | | | | |
|---|---|---|---|---|
| 6,279,284 | B1 * | 8/2001 | Moras | E04F 13/007 52/483.1 |
| 2002/0139075 | A1 * | 10/2002 | Shubow | E04C 2/049 52/309.12 |
| 2005/0188649 | A1 * | 9/2005 | Hagen | E04C 2/386 52/745.05 |
| 2005/0247021 | A1 * | 11/2005 | Schauffele | E04B 2/58 52/506.06 |
| 2008/0016802 | A1 * | 1/2008 | Rheaume | E04C 2/26 52/220.1 |

(Continued)

*Primary Examiner* — Joshua K Ihezie

(74) *Attorney, Agent, or Firm* — Goodman Law Center, P.C.

(57) ABSTRACT

A panelized building system of construction utilizing a rigid framing combined with foam insulation is disclosed. The system may include a metal roof panel, at least one metal wall panel, a floor panel, at least one metal corner post and at least one foundational component. A single layer of foam insulation encapsulates partially fills a rigid framing and may be molded against a non-stick surface or bonded to an exterior building material. In either case, a single monolithic piece is formed. A utility cavity may be formed interior to the single layer of foam insulation. The exterior face may be textured, undulated, radiused, or shaped in myriad ways. In one method, a user applies a first layer of foam insulation to a wall panel and allows the first layer to dry. A user then applies a second layer of foam insulation to the exterior surface of the first layer.

5 Claims, 11 Drawing Sheets

(56) References Cited

U.S. PATENT DOCUMENTS

| | | | | |
|---|---|---|---|---|
| 2009/0113820 | A1* | 5/2009 | Deans | E04B 1/14 52/800.1 |
| 2010/0011701 | A1* | 1/2010 | Cole | B26D 3/008 52/749.1 |
| 2010/0107536 | A1* | 5/2010 | Tautari | E04B 1/14 52/414 |
| 2010/0236163 | A1* | 9/2010 | Sanders | E04B 1/14 52/145 |
| 2011/0081514 | A1* | 4/2011 | Day | B32B 27/12 428/317.1 |
| 2013/0019549 | A1* | 1/2013 | Henriquez | E04C 2/384 52/220.2 |
| 2013/0074433 | A1* | 3/2013 | Ciuperca | E04B 1/41 52/698 |
| 2013/0104480 | A1* | 5/2013 | Smith | B29C 39/10 52/309.7 |
| 2013/0305643 | A1* | 11/2013 | Singleton | E04C 2/284 52/404.1 |
| 2013/0320579 | A1* | 12/2013 | O'Donnell | B29C 44/1219 264/41 |
| 2014/0115991 | A1* | 5/2014 | Sievers | E04C 2/386 52/309.4 |
| 2015/0093535 | A1* | 4/2015 | Lambach | B29C 44/12 52/745.1 |
| 2018/0187417 | A1* | 7/2018 | Kreizinger | B32B 27/065 |
| 2019/0100917 | A1* | 4/2019 | Malinowski | E04C 2/38 |
| 2019/0257081 | A1* | 8/2019 | Heatly | E04B 1/41 |

* cited by examiner

BUILDING SYSTEM AND METHOD UTILIZING INTEGRATED INSULATION, METHOD TO CONSTRUCT WALL PANEL

This Application is a continuation-in-part application of application Ser. No. 17/125,209 filed on Dec. 17, 2020; application Ser. No. 17/125,209 is a divisional application of application Ser. No. 16/891,785 filed on Jun. 3, 2020; application Ser. No. 16/891,785 is a continuation-in-part of application Ser. No. 15/724,666 filed on Oct. 4, 2017.

Inventors: Edward Malinowski, Wei Wang

BACKGROUND OF THE DISCLOSURE

Technical Field of the Disclosure

The present embodiment relates generally to prefabricated/modular building systems, and more particularly, to a panelized building system having a plurality of building section utilizing structural panels with integrated insulation.

Description of the Related Art

A panelized building system is a form of construction in which all components of a building are prefabricated at a climate-controlled factory, and then shipped to a building site for construction. Panelized building is a form of "prefabricated" or "modular" building. In most instances of panelized buildings, the weather-tight shell can be assembled in a matter of days. Penalization is commonly used in most buildings for roof, wall and floor panels. Choosing a panelized building system allows for completely customized building design that can fit virtually any need. However, these panelized building systems face a number of challenges.

One of these challenges is market acceptance. Some home buyers and some lending institutions resist consideration of modular homes as equivalent in value to site-built homes. While the homes themselves may be of equivalent quality, entrenched zoning regulations and psychological marketplace factors may create hurdles for buyers or builders of modular homes and should be considered as part of the decision-making process when exploring this type of home as a living and/or investment option. Panelized homes have become accepted in some regional areas; however, they are not commonly built in major cities. Panelized homes are becoming increasingly common in Japanese urban areas, due to improvements in design and quality, speed and compactness of onsite assembly, as well as due to lowering costs and ease of repair after earthquakes. Recent innovations allow modular buildings to be indistinguishable from site-built structures. Surveys have shown that individuals can rarely tell the difference between a modular home and a site-built home.

Wood is likely still the most common structural building material. However, recently more and more building owners, designers, architects, and general contractors have opted for metal in construction projects over other materials for its energy efficiency, low maintenance, and durability. Increasingly, however, metal's other key attributes like its striking beauty, clean look, and versatility in both new and retrofit construction are increasing the popularity of metal as a material of choice for many building projects.

Metal holds several advantages over other building materials in addressing day-to-day concerns. For example, metal walls help save on cost, or can be custom-engineered to quickly comply with on code requirements. Further, metal products are flexible which makes it suitable for designing tight or complex spaces. An array of metal types are available, both coated and uncoated which provide endless building design options. Moreover, metal structures are tougher and so require fewer repairs when compared to other conventional building materials. There is less wear and tear, which increases the longevity of the buildings. The components of a metal building are created inside a factory giving a much higher quality level. Each piece is checked prior to shipping; thus, the overall quality of the building is generally superior to buildings made of other materials. Since they are created in factories and shipped to the assembly site, metal building goes together in a fraction of the time compared to that required for other structures. Also, bad weather has far less effects on metal construction, as the majority of the work is done indoors, prior to assembly. Another significant advantage of metal structures is that they can be recycled. Once metal buildings have outlived their purpose, they can be recycled. Even though there are numerous benefits, building with metal does face some drawbacks.

One drawback of utilizing metallic panelized building systems is providing proper insulation. Unlike wood, which is classified as an insulative material, most metals are certainly heat conductors.

Condensation is a major concern in metal and steel buildings. Insulation serves to protect a metal building from condensation, which can cause damage over time. Insulation creates a vapor barrier to reduce the amount of condensation taking place directly on the steel panels. Another issue with a steel or metal building is humidity. A concrete foundation that is not fully cured can be a contributing factor to increased humidity and condensation. Steel or metal buildings located in colder climates can experience condensation from exposure to ice and frost. A regular pattern of freezing and thawing can cause frost to melt, drip water and produce condensation. Insulation placed around the red iron before metal sheeting is installed creates a "thermal break" between outside sheeting and internal framing to prevent condensation.

Protection from mold is another major challenge facing metal building.

Insulation that is not properly installed may trap mold within the walls of a metal building. Improper maintenance is another common cause of mold in steel buildings. Animals and birds may damage insulation in metal buildings as they try to create a home. It is not always possible to prevent every possible cause of mold. The best defense is to be aware of what is going on inside the walls of a building. This is accomplished with regular inspections using special equipment to detect possible insulation issues. Once an issue is inspected, the area in question needs to be opened to correct the issue. This may include replacing insulation that is damaged.

One of the existing insulation provides loose fill insulation. This type of insulation consists of loose fibers or fiber pellets. These fibers are blown into building cavities with special equipment. Loose-fill insulation can be more expensive, but does fill corners better and reduces air leakage. Additionally, this type of insulation provides a better sound barrier. Cellulose fiber is made from recycled newspapers that have been chemically treated to be flame retardant and resistant to moisture. This is a good option when looking to take advantage of green construction perks. Loose fill insulation is generally used in walls, attics and floors where it is applied through a moist-spray technique or a dry-pack process. Rock wool or fiberglass provides fuller coverage that is better for steel or metal buildings where it is applied using a Blow-in-Blanket system that blows the insulation into open stud cavities.

Another existing insulation provides mineral fiber consisting of rock wool or processed fiberglass. This insulation is usually the most inexpensive of the insulation available for use in walls. However, it has to be installed carefully to be effective. This type of insulation is generally used in floors, ceilings and walls. This insulation works best for stud spacing of 16-24 inches or a standard joist. Some other forms of insulation include a radiant barrier backing. However, this is especially effective in steel or metal buildings due to the lack of natural insulation.

Certain existing insulation provides a rigid board insulation usually made from polyurethane, fiberglass or polystyrene. It can be cut to the desired thickness and is best for reproofing on flat roofs. It is also good for use on basement walls or as perimeter insulation in cathedral ceilings. It can also be used on concrete slab edges. However, this insulation needs to be covered with ½-inch gypsum board or other flame-retardant materials when applied to interior spaces. Moreover, weather-proof facing is required for exterior applications. Local municipalities may require additional covering.

Fiberglass is often used to insulate in steel and metal buildings. Black or white vinyl fencing laminated on one side is usually a feature of the insulation to prevent moisture. White facing is sometimes used to counter the impact of ambient light by reflecting it away from the surface of the building.

Another existing insulation provides a spray foam insulation which is a liquid having a foaming agent and a polymer such as polyurethane. The liquid mixture is sprayed into walls, floors and ceilings. Spray foam insulation expands as it is applied and turns into a solid cellular plastic consisting of air-filled cells. This type of insulation is good for steel and metal buildings because it fills every space, no matter how small. This type of insulation is ideal for usually shaped designs or getting around obstructions. Spray foam insulation is more expensive than batt insulation, but provides a better air barrier. This is a major plus for metal and steel buildings. Additionally, spray foam insulation does not require caulking and other additional barriers since it is already airtight. However despite the above mentioned insulations, there still exists a substantial unmet need for techniques to efficiently and effectively provide insulation with regard to panelized metal buildings.

Therefore there is a need for a panelized metal building system having an integrated insulation which can efficiently and effectively provide insulation. Such a panelized metal building system would increase structural integrity and reduce or eliminate costly and cumbersome onsite labor. This system would provide protection from mold, protection from condensation, and increase market acceptance. This system would not cause any weather damage during construction as the building is prefabricated in an indoor climate controlled facility and would be precision engineered to highest quality. Such a system would be environmental friendly and would be adaptable to service at remote locations. This system would be stronger than traditional buildings and are often easier to add on to. The present embodiment overcomes the existing shortcomings in this area by accomplishing these objectives.

SUMMARY OF THE DISCLOSURE

To minimize the limitations found in the prior art, and to minimize other limitations that will be apparent upon the reading of the specification, the preferred embodiment of the present invention provides a panelized building system having a plurality of building sections having structural panels with integrated insulation.

The panelized building system of the present invention comprises at least one structural roof panel with integrated insulation and a load bearing structure, at least one structural wall panel with integrated insulation, at least one structural floor panel with integrated insulation, at least one structural corner post, a structural foundational component and a plurality of alignment components. The roof panel, the wall panel, the floor panel, the corner post, and the foundational component are configured to mechanically lock with each other to form a panelized building. The mechanical interlocking system of the present invention eliminates or at least reduces the typical need for connective elements such as nails, screws, bolts etc. The mechanical interlocking system of the present invention also substantially reduces the amount of labor necessary to put together the panelized metal building. Optionally, the mechanical interlocking system may comprise a tongue-and-groove mechanical interlocking system. In this optional embodiment, one component includes a female groove along its edge and a second component includes a male tongue component configured to insert into the female groove and mechanically lock. The interlocking system provides restrain to prevent two connecting components from shifting. This embodiment may further include a foldable roof panel with an offset hinge system. A spandrel floor panel with an interlocking metal spandrel beam may also be included, the beam being capable of mechanically interlocking with one of the wall panels in the manner described above. A number of different kinds of metal could be used with the present invention. Steel is most likely to be used due to its strength and durability. Importantly, the present invention may optionally function using recycled metals, to create an environmentally friendly building system.

One embodiment of the present invention comprises an integrated composite insulation and non-composite insulation. The integrated composite insulation building panel comprises a structural framing attached to a layer of reinforcing element. The layer of reinforcing element is selected from a group consisting of, but not limited to: expanded metal, perforated metal, welded wire mesh, woven wire mesh, carbon fiber, glass fiber and other suitable material. The layer of reinforcing element is infused with a foam insulation to form a composite solid piece, i.e. the composite foam insulated structural panel. The foam insulation can be polyurethane or other suitable materials common in the art. The composite foam insulation contributes to the strength, load bearing quality and structural integrity of the panel in addition to providing insulation. The composite foam insulation also reduces or eliminates the labor needed to add insulation to the building onsite. In the present invention, the insulation is installed into the panels prior to field construction rather than having to be added afterwards at a job site. This enhances one of the key advantages of panelized/prefabricated building and avoids costly and cumbersome onsite labor. The insulated modular building panel may optionally be further encapsulated with spray-on composite foam insulation thereby providing even greater insulation. A reflective thermal insulation covering at least one side of the panel may be optionally utilized.

In another embodiment, the present invention comprises a building panel for use in a panelized building system. The building panel includes an exterior layer element. The exterior layer element may comprise any material suitable for a building façade. Examples include, without limitation, wherein the exterior layer may include element selected from the group comprising a solar panel, plywood, sheet metal, glass, plastic, vinyl, and felt paper. This embodiment may further include a structural frame element having an exterior side, a lateral side, and an interior side. Composite insulation encapsulates the exterior side of the structural frame element, fills a space between the metal frame element and the exterior layer, and bonds to the exterior layer element. In this present disclosed invention, this type of insulation as disclosed in this embodiment is referred as integrated composite insulation.

Optionally, this embodiment may include a permeable reinforcing element attached to the exterior side of the structural frame element such that the permeable reinforcing element is parallel to the exterior layer element, the permeable reinforcing element is encapsulated by foam insulation that is installed between the exterior side of the structural frame and the exterior layer. The insulation with reinforcing element is referred as integrated reinforced composite insulation in the present invention.

In another method, a user can apply a first layer of foam insulation to a wall panel. The first layer of foam insulation fills a predetermined amount of space between the rigid framing and the insulation reinforcement wire mesh, thereby encapsulating the wire mesh. Further, the first layer of foam insulation encapsulates a first flange of the rigid framing. A utility cavity is left between an interior face of the first layer of foam insulation and a second flange of the rigid framing. In the next step, the first layer of foam insulation is allowed to dry so that a solid monolithic piece is formed. A user can next apply a second layer of foam insulation to the exterior surface of the first layer of foam insulation. The second layer of foam insulation fills all remaining space outside of the rigid framing and includes a region of excess foam insulation above the rigid framing. The second layer of insulation bonds to and completely covers the first layer of insulation. Further, the second insulation layer bonds to and completely covers the second flange of the rigid framing. After applying the second layer of foam insulation, the insulation layer is allowed to dry so that a solid monolithic piece is formed. A user can then cut away the region of excess foam insulation as desired, such as cutting by mechanical means.

It is a first objective of the present invention to provide a panelized structural building system having an integrated insulation which can efficiently and effectively provide insulation.

A second objective of the present invention is to provide a panelized structural building system that increases structural integrity and reduces or eliminates cost and cumbersome onsite labor.

A third objective of the present invention is to provide a system that provides protection from mold, insect damage, condensation and increased market acceptance.

Another objective of the present invention is to provide a system that does not cause any weather damage during construction.

Yet another objective of the present invention is to provide a system that is environmentally friendly and adaptable to service at remote locations.

These and other advantages and features of the present invention are described with specificity so as to make the present invention understandable to one of ordinary skill in the art.

BRIEF DESCRIPTION OF THE FIGURES

Elements in the figures have not necessarily been shown to scale in order to enhance their clarity and improve understanding of these various elements and embodiments of the invention. Furthermore, elements that are known to be common and well understood to those in the industry are not depicted in order to provide a clear view of the various embodiments of the invention, thus the figures are generalized in form in the interest of clarity and conciseness.

The foregoing summary as well as the following detailed description of the preferred embodiment of the present invention will be best understood when considered in conjunction with the accompanying figures, wherein like designations denote like elements throughout the figures, and wherein.

DETAILED DESCRIPTION OF THE FIGURES

In the following discussion that addresses a number of embodiments and applications of the present invention, reference is made to the accompanying figures that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1B:
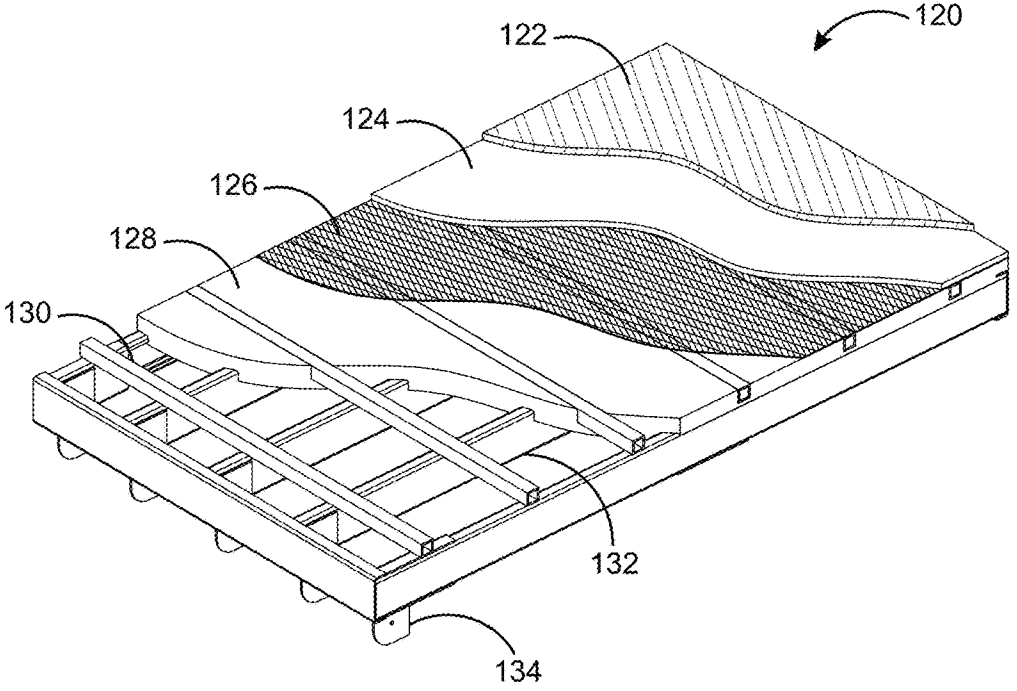
FIG. 1B illustrates a cut away view of a roof panel in accordance with the preferred embodiment of the present invention.
Figure 1A:
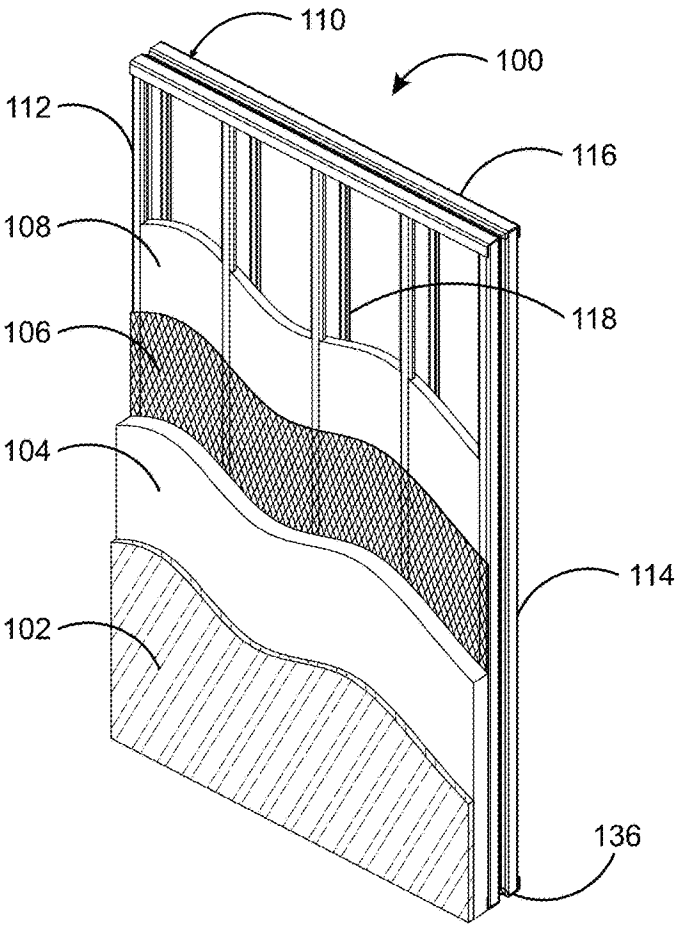
FIG. 1A illustrates a cut away view of a wall panel in accordance with the preferred embodiment of the present invention.

FIG. 1A illustrates a wall panel 100 employed in the panelized building system. This embodiment comprises an integrated composite insulation and non-composite insulation. The integrated composite insulation building panel includes a structural framing attached to a layer of reinforcing element. The layer of reinforcing element can be selected from a group consisting of, but not limited to: expanded metal, perforated metal, welded wire mesh, woven wire mesh, carbon fiber, glass fiber and other suitable material, or any combination thereof. This layer of reinforcing element is described herein as an "insulation reinforcement mesh." The insulation reinforcement mesh can be adhered to an exterior face of rigid framing using mechanical attachment. The term "mechanically attached" is well known in the field as a physical method of combining multiple components. Welding, machine fastening, and weaving wire mesh are considered examples of mechanical attachment. Welded or machined fastened to one face of the flange side is a wire mesh or expanded metal. The embodiment includes a fabricated galvanized C Channel, mechanically attached to form the wall panel 100. The invention achieves multiple purposes. First, it adds sheer value to the wall panel 100. Second, because it is encapsulated in urethane foam, it generates a complete integration of steel and urethane foam composite.

Once the wall panel 100 is constructed, the next process is the application of the foam insulation. The wall panel 100 is elevated off a surface. The surface can be flat or radiused to match a particular contour required based on specifications. For example, a 20-foot radius can be implemented to add architectural value. An exterior (outermost layer) of the wall panel 100 is set at a distance away from the interior to enable the formation of continuous insulation, as required by government code. Continuous insulation is defined in the relevant art as insulation that is continuous across all structural members without thermal bridges other than fasteners and service openings. The term "continuous insulation" is used interchangeably herein with the term "single layer of foam insulation." Another term to describe the outermost layer of the wall panel 100 is a wall exterior layer 102. The urethane foam insulation can adhere to the surface of any wall exterior layer product that may be implemented, without the use of mechanical fasteners. The side of the wall panel 100 is closed in with a non-stick surface allowing for foam varying in thickness as required by specifications. The invention is a significant improvement in the field because it does not require pre-formed insulation that must be cut to fit into a panel shape. Further, for a design with a radiused or specific shape, flexible continuous insulation is an improvement over rigid foam material that will not bend. The urethane foam of the present invention is liquid and forms completely to any shape required. The foam expands through the wall panel 100 and encapsulates wire mesh or expanded metal. Further, the foam expands into the panel frame to the insulation thickness required, forming a steel and urethane composite.

Referring to FIG. 1A, the wall panel 100 adaptable for use in the panelized building system comprises a wall exterior layer 102, a first wall insulation 104, a wall insulation reinforcement 106, and a second wall insulation 108 impregnated in a rigid framing 110. The wall insulation reinforcement 106 can be an insulation reinforcement mesh. The outermost layer of the wall panel 100 is the wall exterior layer 102. Below the wall exterior layer 102, resides the first wall insulation 104. Beneath the first wall insulation 104 resides the wall insulation reinforcement 106 and the second wall insulation 108. The wall insulation reinforcement 106 is encapsulated with the first wall insulation 104 and the second wall insulation 108. The rigid framing 110 includes a vertical male stud 112, a vertical female stud 114, a plurality of C-studs 118 positioned between the vertical male stud 112 and the vertical female stud 114, a top horizontal female track 116 and a bottom horizontal female track 136.

The method described in this paragraph and the aforementioned paragraphs is used for constructing a wall panel 100. The method and system can also be implemented in other panels, such as a roof panel 120 or floor panel 138. The foam insulation is implemented in a single application to form a single monolithic layer ("single layer"). Referring to FIG. 1A, the first wall insulation 104, second wall insulation 108, the reinforcement 106, and framing 110 are all one single monolithic piece. In order to show the individual components of the wall panel 100 in FIG. 1A, each component "appears" as a separate layer even though it is actually a single layer. A single layer is formed through a single application of foam insulation. This single layer system differs from systems which have multiple layers as a result of separate, non-continuous applications of foam. The single continuous application of foam creates a continuous portion formed exterior to the rigid framing 110 and interior to the wall exterior layer 102. The single layer of foam insulation adheres to the wall exterior layer 102. Further, the single layer encapsulates the insulation reinforcement mesh and partially fills the rigid framing, thereby forming a cavity insulation portion of the single application layer of foam insulation interior to the insulation reinforcement mesh. Non-limiting examples of wall exterior layers 102 are membrane, plywood, sheet metal, felt paper, glass, plastic, vinyl and the like. Cavity wall insulation is used to reduce heat loss through a cavity wall by filling the air space with material that inhibits heat transfer. This immobilizes the air within the cavity (air is still the actual insulator), preventing convection, and can substantially reduce space heating costs.

Referring to FIG. 1B, a roof panel 120 of the panelized building system is illustrated. The roof panel 120 includes a roof exterior layer 122, a first roof insulation 124, a roof insulation reinforcement 126 and a second roof insulation 128. The roof exterior layer 122 is the outermost layer of the roof panel 120. The first roof insulation 124 is beneath the roof exterior layer 122. Below the first roof insulation 124 is the roof insulation reinforcement 126 and the second roof insulation 128. The roof panel 120 further includes a plurality of purlins 130, a plurality of rafters 132 and a plurality of hinge plates 134.

Under the present invention, no outer layer of building material is necessary for any of the panel embodiments disclosed. Rather, the panels of the present invention may be assembled by positioning a metal frame (or other rigid framing element) as disclosed herein over a non-stick surface, such as polypropylene. The rigid framing of the panel is elevated from the non-stick surface and may be secured with a jig, leaving a required space between the outer face of the metal or rigid framing and the non-stick surface. The required spaced may be modified to achieve a desired insulation value (R-Value). Then, the single application of liquid foam insulation may be applied to fill the interior spaces of the rigid structural components and the space in between the rigid structural components and the non-stick surface. Then the panel formed by the rigid framing integrated with the single application of liquid foam insulation (after the liquid foam solidifies) is removed from the non-stick surface. This leaves a solid monolithic piece formed by the single application of liquid foam insulation fused to the other structural components of the panel. Other systems in in the field require an outer layer of building material or rigid foam insulation to create a surface to add additional insulation thereon. Also, utilizing the present invention, the outer surface of the panel may be of any shape because the shape of the single application of liquid foam insulation would conform to any shape that it is molded against. For instance, the panel may be radiused as shown in FIG. 1D. It could be corrugated; it could be a sphere; it could be textured; it could include raised and lowered sections. As well, the rigid framing may be of any shape because the single application of liquid foam insulation would conform to the shape of the rigid framing. In other systems in the field, the foam must be custom cut to match up with the shape of the rigid framing. For example, a triangular frame would require the cutting of a triangular piece of outer building material or a triangular piece of exterior rigid insulation. Further, the single application of liquid foam insulation of the panel of the present invention may be of any thickness to provide any level of insulation capacity (R-Value) without any additional exterior insulation layer or exterior building material. No preformed or pre-cut material is necessary. Optionally, the panel may be molded up against felt or plywood. In other systems in the field, it is imperative that an outer layer of building material or rigid foam insulation to install the required interior foam insulation is included to achieve the required R-value. The foam insulation is also used to bond the rigid framings and the outer layer of building material together to form a building panel.

Figure 1C:
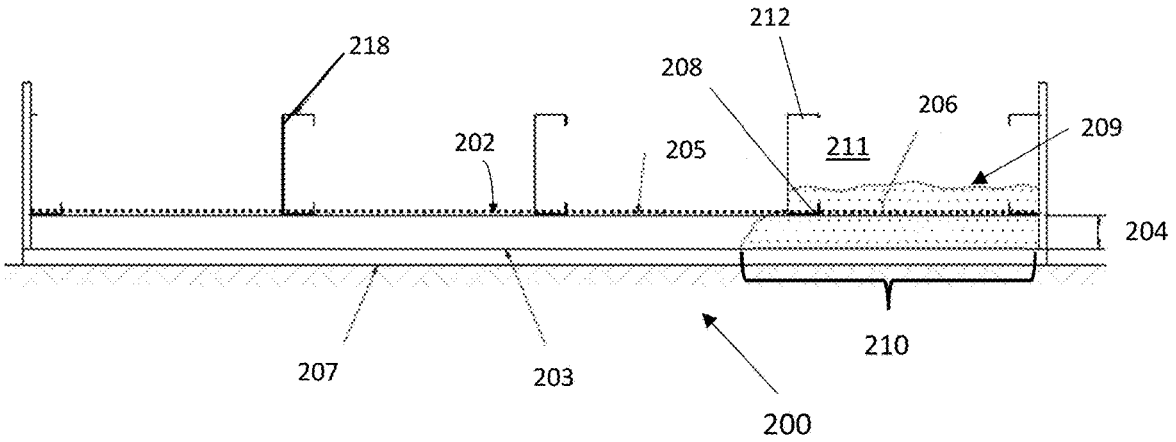
FIG. 1C illustrates a rigid framing of a wall panel elevated from a surface with an insulation reinforcement mesh.
Figure 1D:
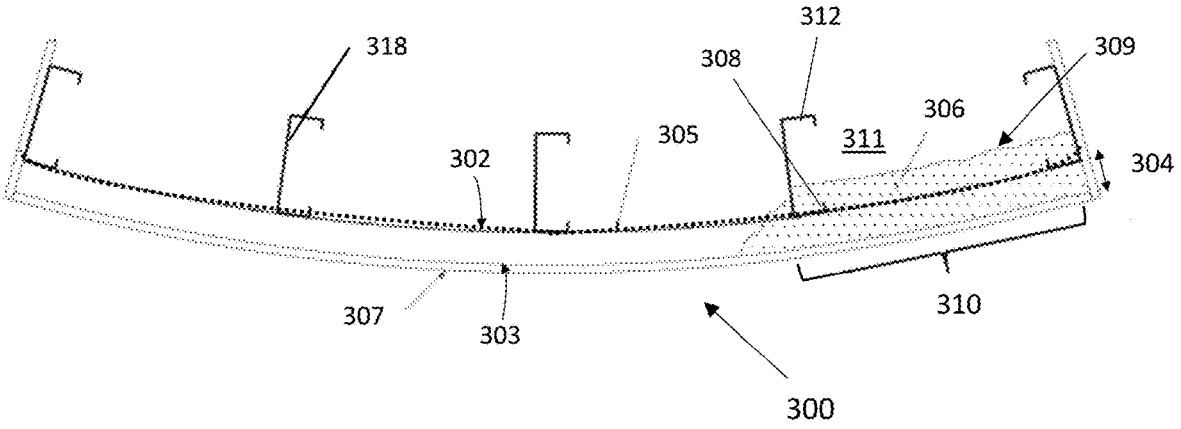
FIG. 1D illustrates a rigid framing of a radiused wall panel elevated from a surface with an insulation reinforcement mesh.

Referring to FIG. 1C, a rigid framing 202 of a wall panel 200 is elevated from the non-stick surface 202. The non-stick surface 203 is removable and can be replaced with different non-stick surfaces with various shapes and textures. The exterior face 210 of a single layer of foam insulation can have various shapes and textures as a result of being molded to different removable non-stick surfaces 203. The spacing 204 between the rigid framing 202 and the non-stick surface 203 can be set at any desirable thickness for application of the single layer of foam insulation 206. The foam insulation 206 has a preferred thickness thereby allowing compliance with applicable building codes. Two to six inches is a common thickness for the single layer of foam insulation 206. The single layer of foam insulation 206 can be installed on the interior, exterior, or is integral to any opaque surface of the building envelope. The rigid framing 202 can also have a plurality of C-studs 218. Alternatively, the rigid framing can include a vertical male stud, a vertical female stud, a top horizontal female track, and a bottom horizontal female track. The stud and track elements are shown in detail with reference to FIG. 1A.

As shown, the foam insulation 206 extends beyond an exterior surface of the rigid framing 202. The single layer of foam insulation 206 partially fills the rigid framing 202 and encapsulates an exterior flange 208 of the rigid framing 202. A utility cavity 211 is formed between an interior face 209 of the single layer of foam insulation and an interior surface 212 of the rigid framing 202. The utility cavities 211 can be used for installing utility lines, as is well known in the field. Optionally, the non-stick surface may be replaced by a building product, said building product may comprise plywood, glass, vinyl, sheet metal, stone, felt paper, and/or similar materials.

The rigid framing 202 can optionally be attached to a layer of reinforcing element 205, also referred to as an "insulation reinforcement mesh." The layer of reinforcing element 205 can be selected from a group consisting of, but not limited to: expanded metal, perforated metal, welded wire mesh, woven wire mesh, carbon fiber, glass fiber and other suitable material, or any combination thereof. The insulation reinforcement mesh 205 can be adhered to the rigid framing 202 using mechanical attachment or other suitable means. The term "mechanically attached" is well known in the field as a physical method of combining multiple components. Welding, machine fastening, and weaving wire mesh are considered some examples of mechanical attachment. Further, the single layer of foam insulation 206 can encapsulate the insulation reinforcement mesh 205. Once the insulation reinforcement mesh 205 is encapsulated, it becomes an integral part of the continuous portion of the single layer of foam insulation 206 exterior to the rigid framing 202.

The single application layer of foam insulation 206 may be applied to fill the interior spaces of the rigid structural components and the space in between the rigid structural components and the non-stick surface 203. The single layer of foam insulation 206 partially fills the rigid framing 202 and encapsulates an exterior flange 208 of the rigid framing 202. A utility cavity 211 is formed between an interior face 209 of the single layer of foam insulation and an interior surface 212 of the rigid framing 202. Next, the single layer of foam insulation 206 is allowed to dry so that a solid monolithic piece is formed. The solid monolithic piece formed is comprised of the single application layer of foam insulation 206 fused to the rigid framing 202. Then, the panel formed by the rigid framing 202 integrated with the single application of liquid foam 206 insulation (after the liquid foam solidifies) is removed from the non-stick surface 203. Alternatively, a building product as described earlier may replace the non-stick surface 203. If a building product is used, the building product would not be removed from the other components. Rather, it would adhere and become part of the panel. Further, an insulation reinforcement mesh may be adhered to the rigid framing using mechanical attachment or other means. The insulation reinforcement mesh can be encapsulated with the single layer of foam insulation so that the solid monolithic piece includes the insulation reinforcement mesh and the building product if a building product is substituted for a non-stick surface.

Referring to FIG. 1D, the rigid framing 302 of the wall panel 300 is elevated from the non-stick surface 303. The non-stick surface 303 is removable and can be replaced with different non-stick surfaces with various shapes and textures. The exterior face 310 of a single layer of foam insulation can have various shapes and textures as a result of being molded to different removable non-stick surfaces 303. In this embodiment, the wall panel 300 is radiused to a particular contour required based on specifications. The wall panel exterior 307 is bent (curved) in contrast to the straight wall panel exterior 207 shown in FIG. 1C. The spacing 304 between the rigid framing 302 and the non-stick surface 303 can be set at any desirable thickness for application of the single layer of foam insulation 306. The foam insulation 306 has a preferred thickness thereby allowing compliance with applicable building codes. Two to six inches is a common thickness for the single layer of foam insulation 306. The single layer of foam insulation 306 can be installed on the interior, exterior, or is integral to any opaque surface of the building envelope. As shown, the foam insulation 306 extends beyond an exterior surface of the rigid framing 302. The single layer of foam insulation 306 partially fills the rigid framing 302 and encapsulates an exterior flange 308 of the rigid framing 302. A utility cavity 311 is formed between an interior face 309 of the single layer of foam insulation and an interior surface 312 of the rigid framing 302. The rigid framing 302 can optionally be attached to an insulation reinforcement mesh 305. Further, the single layer of foam insulation 306 can encapsulate the insulation reinforcement mesh 305. Once the insulation reinforcement mesh 305 is encapsulated, it becomes an integral part of the continuous portion of the single layer of foam insulation 306 exterior to the rigid framing 302. The rigid framing 302 can also have a plurality of C-studs 318.

The single application layer of foam insulation 306 may be applied to fill the interior spaces of the rigid structural components and the space in between the rigid structural components and the non-stick surface 303. The single layer of foam insulation 306 partially fills the rigid framing 302 and encapsulates an exterior flange 308 of the rigid framing 302. A utility cavity 311 is formed between an interior face 309 of the single layer of foam insulation and an interior surface 312 of the rigid framing 302. Next, the single layer of foam insulation 306 is allowed to dry so that a solid monolithic piece is formed. The solid monolithic piece formed is comprised of the single application layer of foam insulation 306 fused to the rigid framing 302. Then, the panel formed by the rigid framing 302 integrated with the single application of liquid foam 306 insulation (after the liquid foam solidifies) is removed from the non-stick surface 303. Further, an insulation reinforcement mesh may be adhered to the rigid framing using mechanical attachment or other means. The insulation reinforcement mesh can be encapsulated with the single layer of foam insulation so that the solid monolithic piece includes the insulation reinforcement mesh.

Figure 1E:
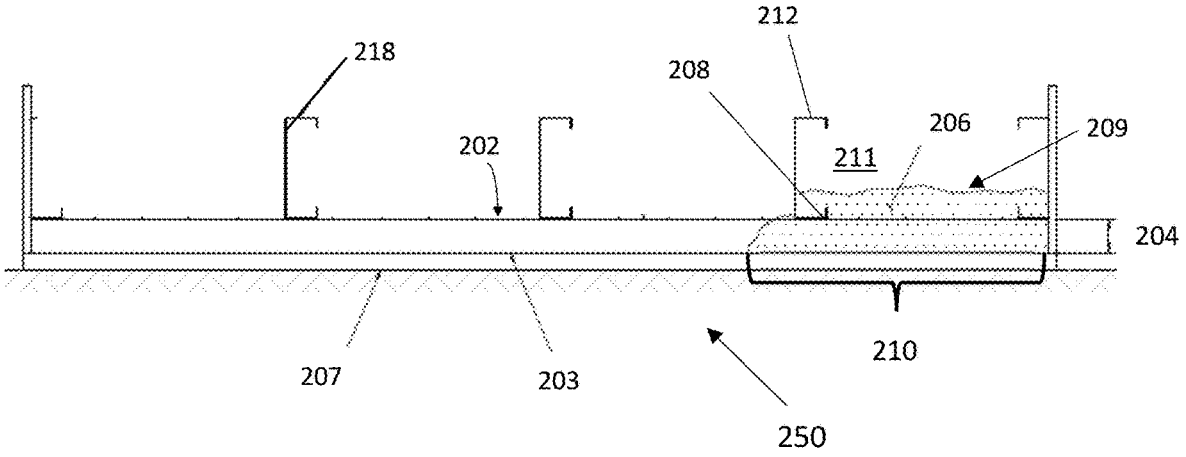
FIG. 1E illustrates a rigid framing of a wall panel elevated from a surface without an insulation reinforcement mesh.

Referring to FIG. 1E, a rigid framing 202 of a wall panel 250 is elevated from a non-stick surface 203 but this embodiment has no insulation reinforcement mesh. The wall panel 250 embodiment shown in FIG. 1E is similar to the wall panel 200 in FIG. 1C except for lacking an insulation reinforcement mesh. As aforementioned, the insulation reinforcement mesh 205 shown in FIG. 1C is optional. Further, the insulation reinforcement mesh 305 of the radiused wall panel 300 shown in FIG. 1D is also optional.

Figure 1F:
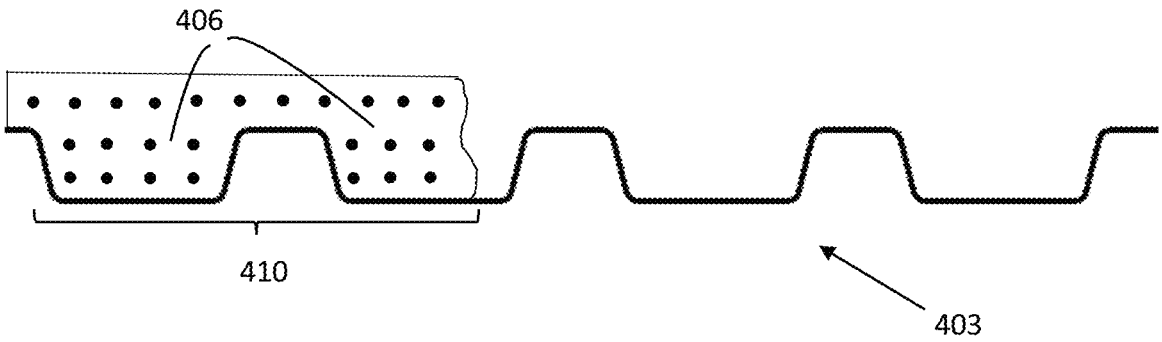
FIG. 1F illustrates the application of a single layer of foam insulation to a corrugated non-stick surface.

Referring to FIG. 1F, an example of a corrugated non-stick surface 403 is illustrated. After applying a single continuous layer of foam insulation 406, the exterior face 410 of the foam insulation is molded against the corrugated non-stick surface 403, thereby enabling the exterior face 410 to also become corrugated. A monolithic layer of foam insulation 406 is formed.

Figure 1G:
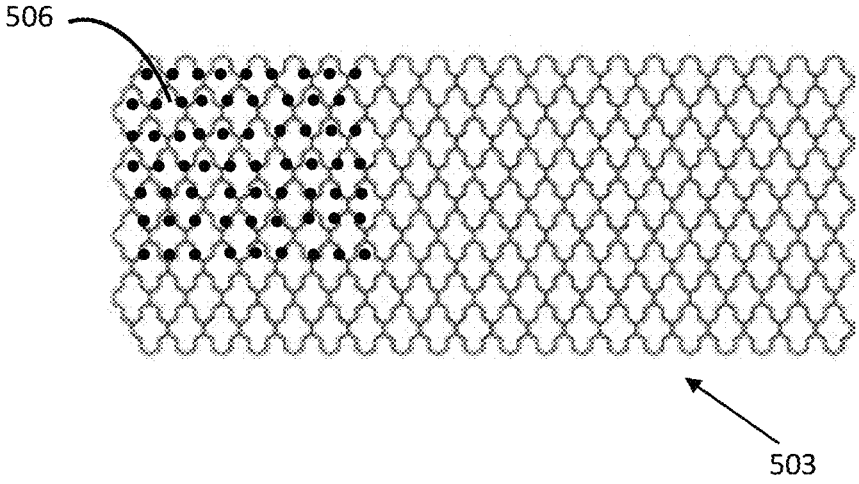
FIG. 1G illustrates the application of a single layer of foam insulation to a textured non-stick surface.

Referring to FIG. 1G, an overhead view of a textured non-stick surface 503 is illustrated. After applying a single continuous layer of foam insulation 506, the exterior face (not visible in overhead view) of the foam insulation is molded against the textured non-stick surface 503, thereby enabling the exterior face to also become textured. The textured non-stick surface 503 illustrated is one example of many possible textures that can be implemented. A monolithic layer of foam insulation 406 is formed.

Figure 1H:
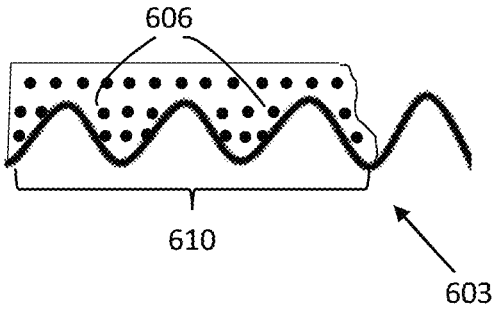
FIG. 1H illustrates the application of a single layer of foam insulation to an undulated non-stick surface.

Referring to FIG. 1H, an example of an undulated non-stick surface 603 is illustrated. After applying a single layer of foam insulation 606, the exterior face 610 of the foam insulation is molded against the undulated non-stick surface 603, thereby enabling the exterior face 610 to also become undulated. A monolithic layer of foam insulation 606 is formed.

Figure 2B:
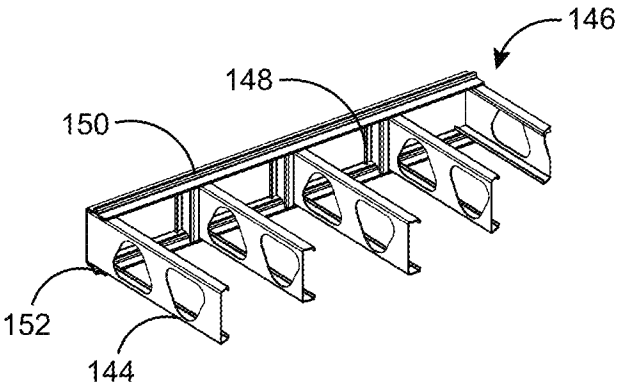
FIG. 2B illustrates a detailed cut away view of the spandrel of the floor panel shown in FIG. 2A in accordance with the preferred embodiment of the present invention.
Figure 2C:
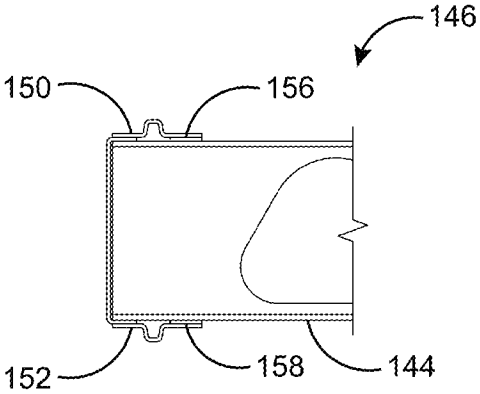
FIG. 2C illustrates a sectional view of the spandrel shown in FIG. 2A in accordance with the preferred embodiment of the present invention.
Figure 2A:
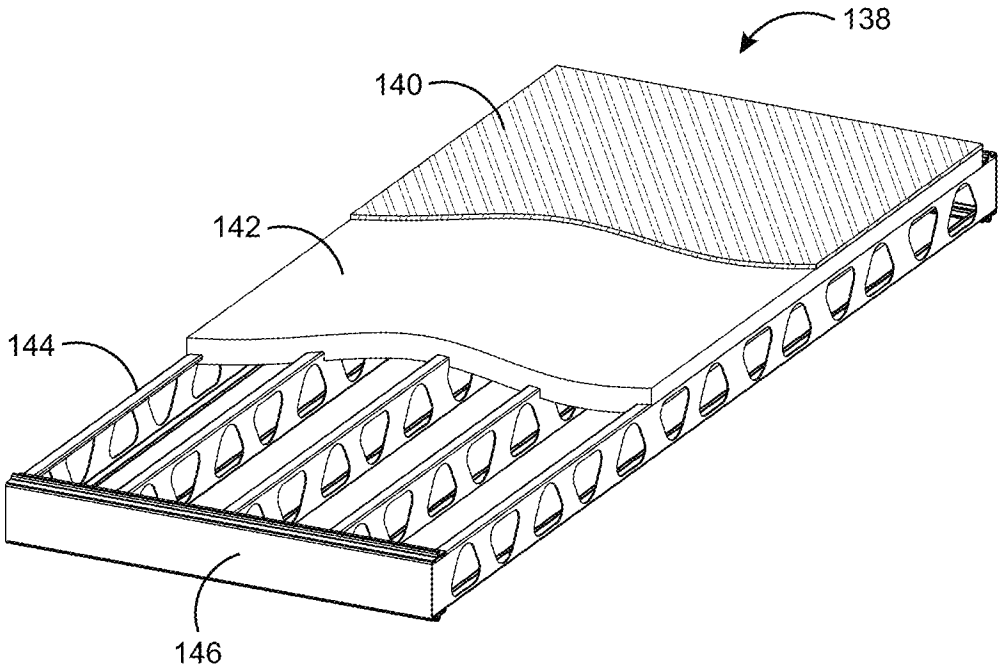
FIG. 2A shows a cut away view of a floor panel, illustrating a spandrel of the floor panel in accordance with the preferred embodiment of the present invention.

Referring to FIG. 2A, a floor panel 138 of the panelized building system is illustrated. The floor panel includes a floor exterior layer 140, a floor insulation 142, a plurality of floor joists 144 and a spandrel 146. FIG. 2B shows a detailed cut away view of the spandrel 146. The spandrel 146 includes a first male floor track 150, a second male floor track 152 holding the plurality of floor joists 144 by means of a plurality of stiffeners 148. FIG. 2C illustrates a sectional view of the spandrel 146. The spandrel 146 further includes a first fill plate 156 connected to the first male floor track 150 and a second fill plate 158 connected to the second male floor track 152 to fix at least one of the plurality of floor joists 144 with the spandrel 146.

Figure 3A:
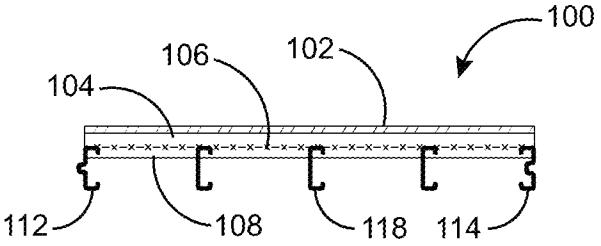
FIG. 3A illustrates a sectional view of the wall panel shown in FIG. 1A in accordance with the preferred embodiment of the present invention.
Figure 3B:
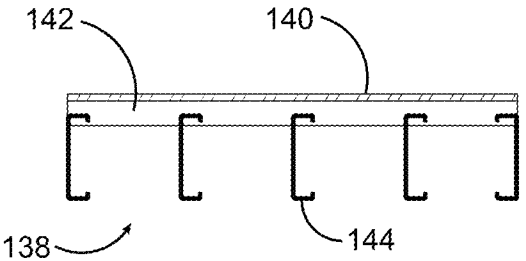
FIG. 3B illustrates a sectional view of the floor panel shown in FIG. 2A in accordance with the preferred embodiment of the present invention.
Figure 3C:
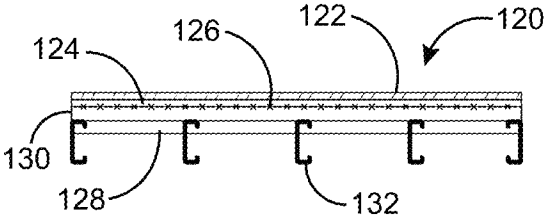
FIG. 3C illustrates a sectional view of the roof panel shown in FIG. 1B in accordance with the preferred embodiment of the present invention.
Figure 3D:
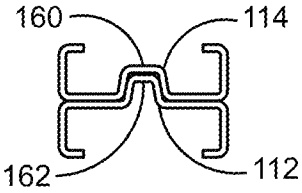
FIGS. 3D and 3E illustrate a detailed view of a tongue and groove of the wall panel shown in FIG. 1A in accordance with the preferred embodiment of the present invention.

FIGS. 3A-3C show the sectional views of the wall panel 100, the floor panel 138 and the roof panel 120. FIGS. 3D and 3E illustrate a detailed view of a tongue 162 and a groove 160 of the wall panel 100 shown in FIG. 1A. There are several advantages of having a feature of an interlocking tongue 162 and groove 160. The interlocking feature enables the panels (e.g. wall panel 100, floor panel 138, roof panel 120) to interlock with the foundation of a building with a minimum number of required fasteners and a maximum sheer strength. Another advantage of the interlocking feature is an improvement in the efficiency of field installation. Once a base track is installed and leveled, there is no need for measuring or checking because the panels are precisely installed. The interlocking tongue 162 and groove 160 feature enables the automatic alignment of the panels. A totally panelized system, including wall panels 100, floor panels 138, roof panels 120, and base plates, eliminates the need to integrate with other installation methods that would require research into fit and fastening requirements. The panelized system enables simpler engineering and construction. Since all the components can be manufactured in a controlled environment, the components can be fit, and the entire structure can be assembled prior to field installation.

Another benefit of the present invention is that all the panels in the structure can be constructed of a single metal, such as steel. This is a significant improvement over hybrid building systems that integrate other construction methods such as floor systems, wood trusses, or roof trusses. Having a steel building structure can provide a shield to filter out various radio frequencies. For example, the steel structure can block out radio frequencies used by cell phones. A steel structure can be used as Faraday cage to eliminate or reduce radio frequencies and electromagnetic radiation. Required frequencies can be filtered into the steel structure through shielded cable while unwanted frequencies can be filtered out. Further, using an appropriate thickness for steel and wire mesh enables the structure to pass a missile test to withstand hurricanes and tornadoes. Having a metal structure without wood protects against insect damage and mold.

Figure 3F:
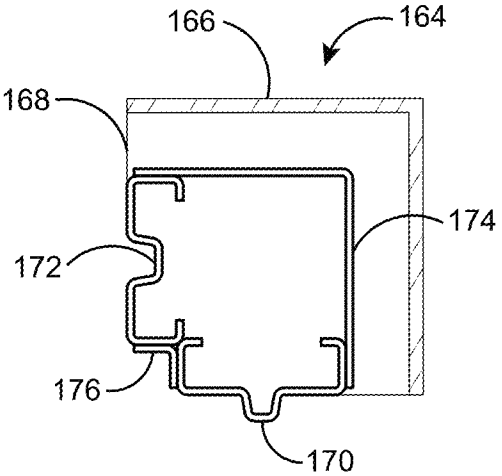
FIG. 3F illustrates a sectional view of a corner post in accordance with the preferred embodiment of the present invention.
Figure 3E:
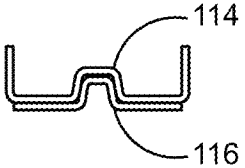
Figure 4:
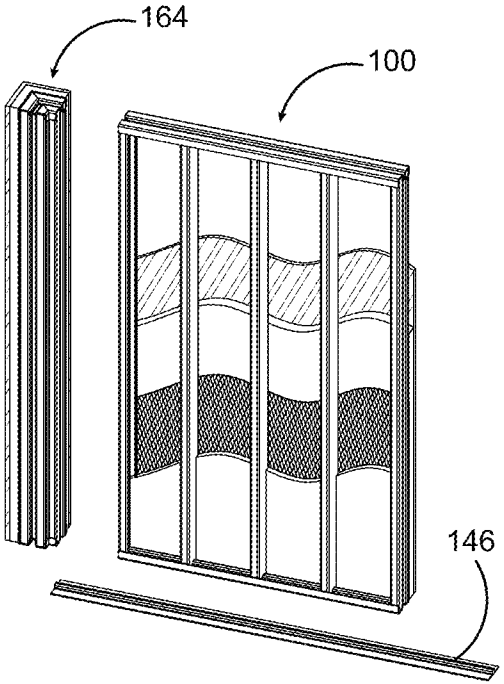
FIG. 4 illustrates a wall assembly showing the wall panel being assembled with the corner post in accordance with the preferred embodiment of the present invention.

FIG. 3F illustrates a sectional view of a corner post 164 in accordance with the preferred embodiment of the present invention. The corner post 164 is adaptable for connecting wall panels 100 at the corners of the panelized building system. The corner post 164 includes a corner exterior layer 166, a corner insulation 168, a corner tongue 170 and a corner groove 172 attached to the corner insulation 168 by means of a pair of connectors 174, 176. The corner tongue 170 and the corner groove 172 enables to attach the wall panel 100 with the corner post 164. The corner tongue 170 attaches with the vertical female stud 114 of the wall panel 100 and the corner groove 172 attaches with the vertical male stud 112 of the wall panel 100. FIG. 4 illustrates a wall assembly showing the wall panel 100 to be assembled with the corner post 164 and to the spandrel 146 of the floor panel 138.

Figure 5:
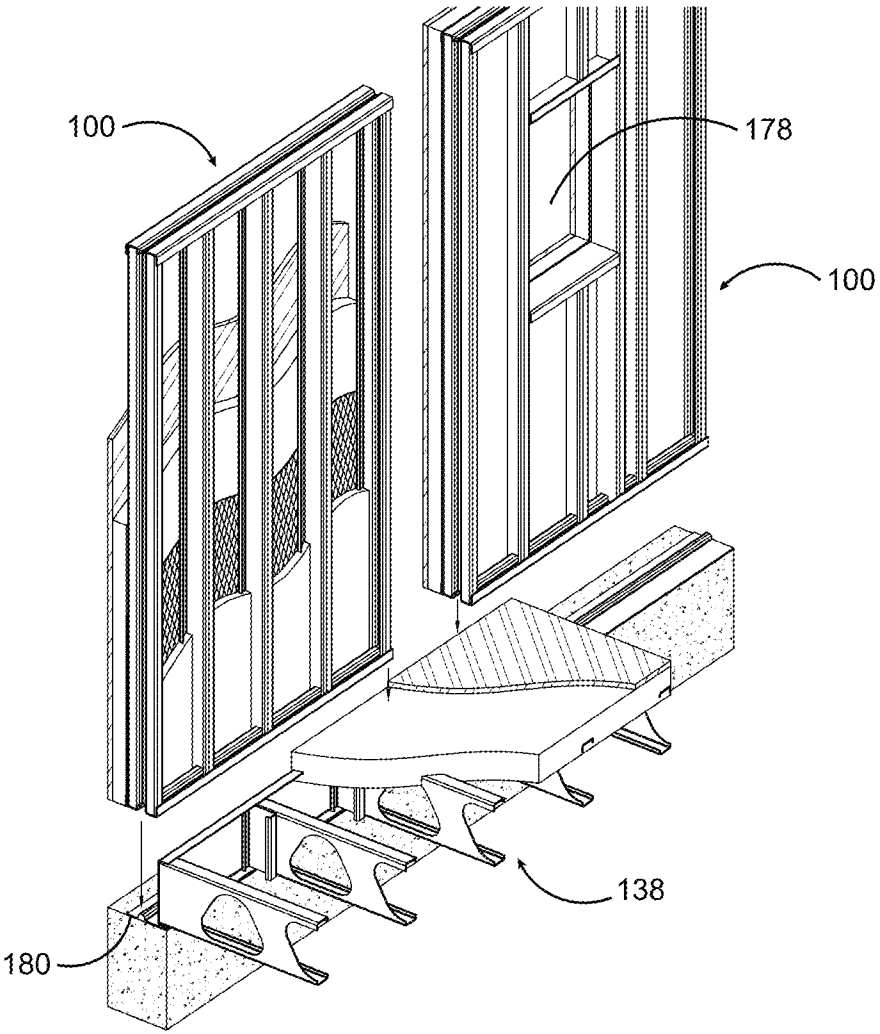
FIG. 5 illustrates a ground floor assembly showing the wall panel being assembled with the ground floor panel in accordance with the preferred embodiment of the present invention.

FIG. 5 illustrates a ground floor assembly showing the wall panel 100 being assembled with the ground floor panel 138. As shown in FIG. 16, the ground floor assembly is designed to firmly assemble the wall panel 100 with or without the window 178 with a base 180.

Figure 6:
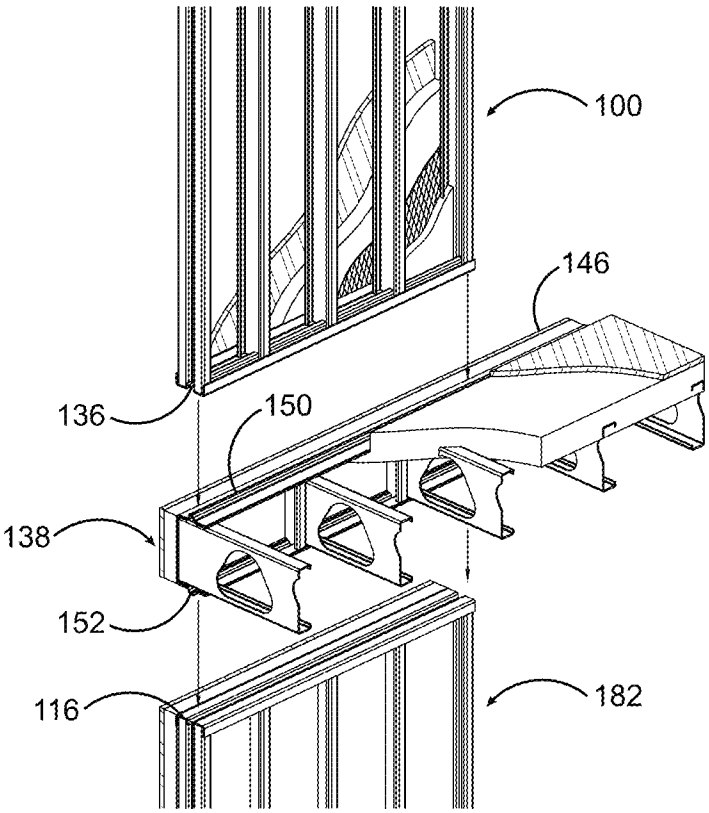
FIG. 6 illustrates another configuration of the floor assembly in accordance with the preferred embodiment of the present invention.

FIG. 6 illustrates another configuration of the floor assembly showing two wall panels 100, 182 being assembled with the floor panel 138. In this configuration, the bottom horizontal female track 136 of one wall panel 100 is positioned on the first male floor track 150 on the spandrel 146 of the floor panel 138 and the top horizontal female track 116 of another wall panel 182 is attached to the second male floor track 152 on the spandrel 146 of the floor panel 138.

Figure 7:
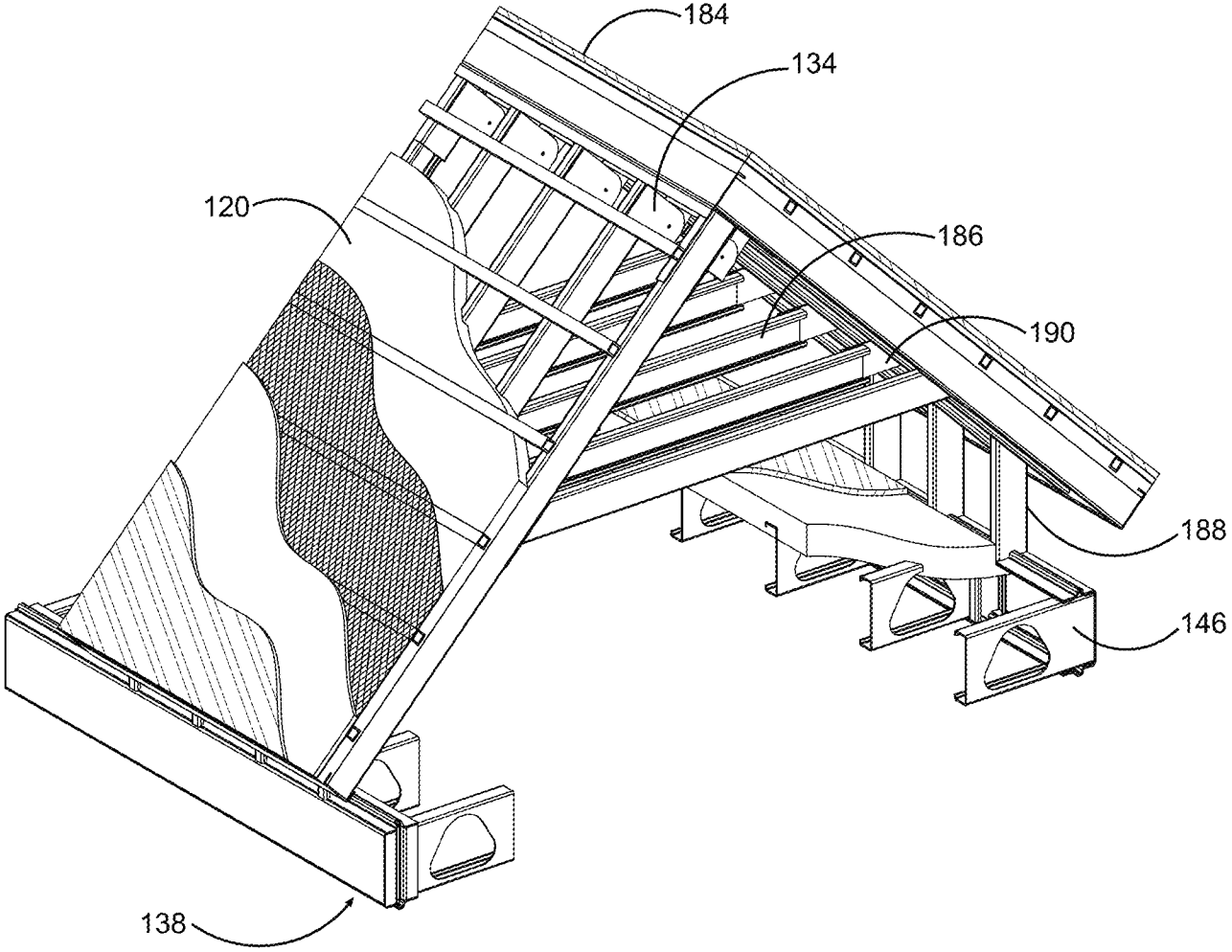
FIG. 7 illustrates a roof to floor assembly showing the roof panel being assembled with the floor panel in accordance with the preferred embodiment of the present invention.

FIG. 7 illustrates a roof to floor assembly showing roof panels attached to floor panels. In this configuration, for example, at least two roof panels 120, 184 are assembled with the floor panel 138. The at least two roof panels 120, 184 are attached together by means of the plurality of hinge plates 134 and held in position by means of a plurality of spreader beams 186 and a plurality of connector plates 190. The at least two roof panels 120, 184 are attached to the floor panel 138 by means of a plurality of support posts 188.

Figure 8B:
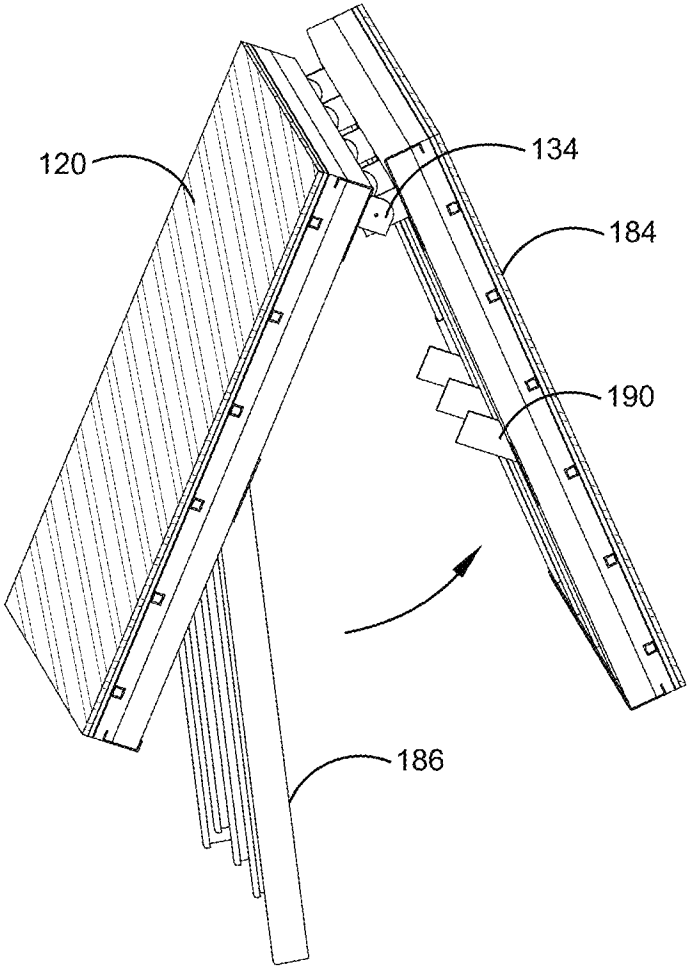
FIG. 8B illustrates the roof panel in an unfolded state in accordance with the preferred embodiment of the present invention.
Figure 8A:
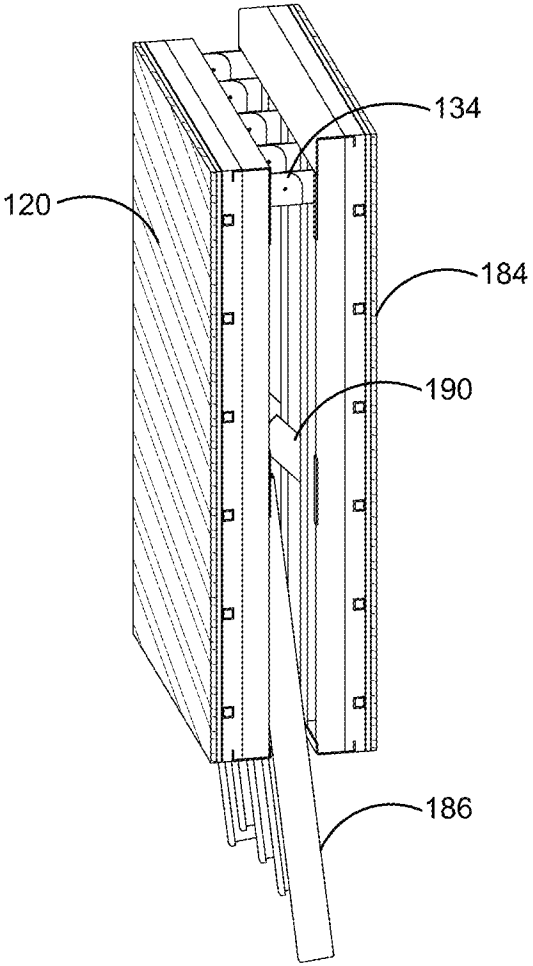
FIG. 8A illustrates the roof panel in a folded state in accordance with the preferred embodiment of the present invention.

FIGS. 8A and 8B illustrate the roof panel assembly in a folded state and an unfolded state respectively. In the folded state, the plurality of connector plate 190 and the plurality of spreader beams 186 are coupled together. In the unfolded state, the plurality of connector plate 190 and the plurality of spreader beams 186 are detached from each other utilizing the plurality of hinge plates 134.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention is not limited by this detailed description, but by the claims and the equivalents to the claims appended hereto.

Figure 9:
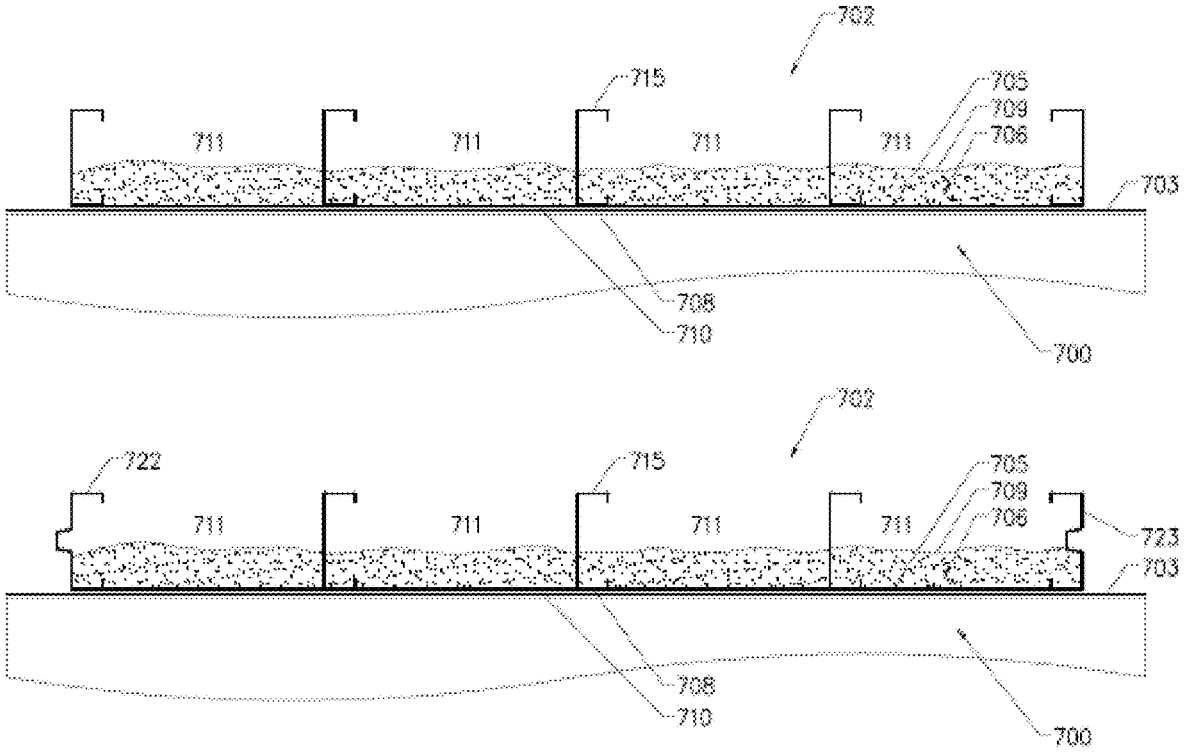
FIG. 9 illustrates a method of applying a first layer of foam insulation to a wall panel.

Referring to FIG. 9, a rigid framing is placed on top of a worktable 700 with a non-stick surface 703. The rigid framing 702 can optionally be attached to a layer of reinforcing element 705, also referred to as an "insulation reinforcement mesh." The layer of reinforcing element 705 can be selected from a group consisting of, but not limited to: expanded metal, perforated metal, welded wire mesh, woven wire mesh, carbon fiber, glass fiber and any other suitable material, or any combination thereof. The insulation reinforcement mesh 705 can be adhered to the rigid framing 702, using mechanical attachment or other suitable means. The term "mechanically attached" is well known in the field as a physical method of combining multiple components. Welding, machine fastening, and weaving wire mesh are considered some examples of mechanical attachment. The rigid framing 702 can include a vertical male stud 722, a vertical female stud 723, a top horizontal track, and a bottom horizontal track. Example stud and track elements are show in detail with cross reference to FIG. 1A. When applying layers of foam insulation 706, the application can be done horizontally or vertically.

A user can apply a first layer of foam insulation 706 to the wall panel 702. The first layer of foam insulation 706 fills a predetermined amount of space between the rigid framing 702 and the insulation reinforcement wire mesh 705, thereby bonding to the wire mesh 705. Once the insulation is bonded to the insulation reinforcement mesh 705, it becomes an integral part of the continuous portion of the first layer of foam insulation 706 interior to the rigid framing 702. Further, the first layer of foam bonds to the interior surfaces of the first flanges 708 and the webs of the vertical studs. As shown, utility cavities 711 are left between an interior face 709 of the first layer of foam insulation 706 and a second flange 715 of the rigid framing 702. The utility cavities 711 can be used for installing utility lines, as is well known in the field.

In the next step, the first layer of foam insulation 706 is allowed to dry so that a solid monolithic piece is formed. The solid monolithic piece formed is comprised of the first layer of foam insulation 706 fused to the rigid framing 702 and the insulation wire mesh 705, thereby leaving exposed an exterior surface 710 of the first layer of foam insulation 706. The rigid panel with first layer of insulation is flipped over. The interior flange is now rested on top of the worktable, leaving the exterior surface 710 facing upward, ready to receive a second application of the foam insulation 720.

Figure 10:
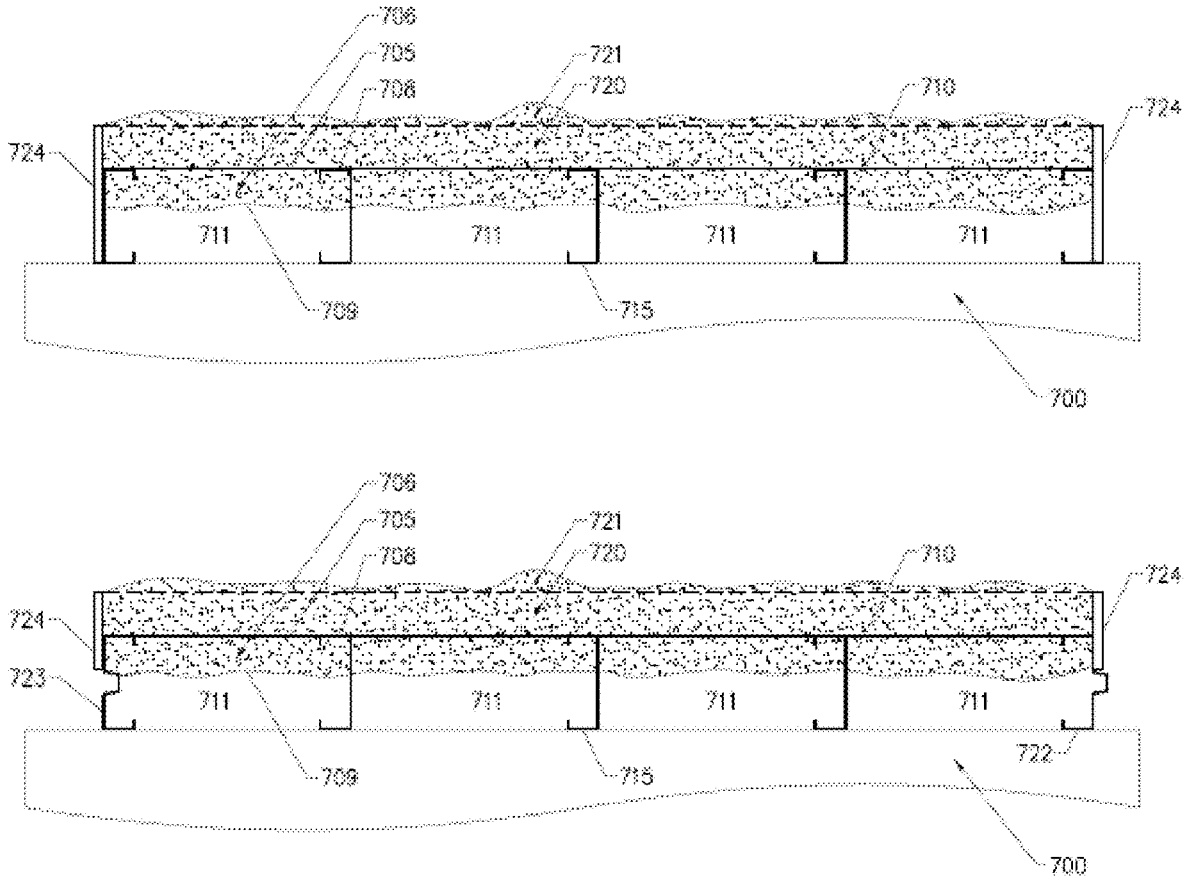
FIG. 10 illustrates a method of applying a second layer of foam insulation to the exterior surface of the first layer of foam insulation.

Referring to FIG. 10, a user can apply side forms with non-stick surface 724 to the perimeter sections of the rigid framing 702. Adding the second non-stick surface 722 creates a cavity of a predetermined thickness for the foam insulation. This will create the desired "R value" to satisfy any building code requirement. The second layer of foam insulation 720 fills all remaining space outside of the rigid framing 702 and includes a region of excess foam insulation 721 above the rigid framing 702. The second layer of insulation 720 bonds to and completely covers the first layer of insulation 706. Further, the second insulation layer 720 bonds to and completely covers the first flange 708 of the rigid framing 702. In addition, the second insulation layer 720 bonds to and completely covers any portion of the insulation wire mesh 705 left uncovered by the first insulation layer 706.

After applying the second layer of foam insulation 720, the insulation layer 720 is allowed to dry so that a solid monolithic piece is formed. A user can then cut away the region of excess foam insulation 721 as desired. The excess foam insulation 721 can be cut to a desired thickness by mechanical means. For example, the mechanical means can include sawing, milling, sanding, and the like. The user removes the side form 724 to complete the panel construction.

What is claimed is:

1. A method of constructing a wall panel comprising the steps of:

a. providing a rigid framing mechanically attached to an insulation reinforcement wire mesh;

b. applying a first layer of foam insulation, the first layer of foam insulation:

i. fills a predetermined amount of space between the rigid framing and the insulation reinforcement wire mesh and it encapsulates the insulation reinforcement wire mesh;

ii. encapsulates a first flange of the rigid framing;

c. leaving a utility cavity between an interior face of the first layer of foam insulation and a second flange of the rigid framing;

d. allowing the first layer of foam insulation to dry wherein a solid piece is formed comprising the first layer of foam insulation fused to the rigid framing and the wire mesh, thereby leaving exposed an exterior surface of the first layer of foam insulation;

e. applying a second layer of foam insulation to the exterior surface of the first layer of foam insulation, the second layer of foam insulation:

i. fills all remaining space outside of the rigid framing and includes a region of excess foam insulation above the rigid framing;

ii. bonds to and completely covers the first layer of foam insulation;

iii. bonds to and completely covers the first flange of the rigid framing;

iv. bonds to and completely covers any portion of the insulation reinforcement wire mesh left uncovered by the first layer of foam insulation;

f. allowing the second layer of foam insulation to dry, thereby forming a solid piece;

g. cutting away the region of excess foam insulation.

2. The method of claim 1, further comprising the step of, applying a non-stick surface to a perimeter section of the rigid framing creating a cavity of a predetermined thickness for the foam insulation.

3. The method of claim 2, further comprising the step of removing the non-stick surface.

4. The method of claim 1, wherein the excess foam insulation is cut to a desired thickness by mechanical means.

5. The method of claim 4, wherein the excess foam insulation is cut to a desired thickness by sawing, milling, and sanding.

* * * * *